US006199980B1

(12) United States Patent
Fisher et al.

(10) Patent No.: US 6,199,980 B1
(45) Date of Patent: Mar. 13, 2001

(54) EFFICIENT FLUID FILTERING DEVICE AND AN INK JET PRINTHEAD INCLUDING THE SAME

(75) Inventors: Almon P. Fisher, Rochester; Gary A. Kneezel, Webster; John R. Andrews, Fairport, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/431,056

(22) Filed: Nov. 1, 1999

(51) Int. Cl.[7] ..... B41J 2/175
(52) U.S. Cl. ..... 347/93
(58) Field of Search ..... 347/93, 92; 210/498, 210/171; 96/204, 206, 220, 219

(56) References Cited

U.S. PATENT DOCUMENTS 4,864,329 9/1989 Kneezel et al. .
5,154,815 10/1992 O'Neill ..... 205/75
5,204,690 4/1993 Lorenze, Jr. et al. .

FOREIGN PATENT DOCUMENTS 2 225 229 * 5/1990 (GB) .

* cited by examiner

*Primary Examiner*—N. Le
*Assistant Examiner*—Judy Nguyen
(74) *Attorney, Agent, or Firm*—Tallam I. Nguti

(57) ABSTRACT

An efficient fluid filtering device is provided for filtering unwanted contaminants from flowing fluid, such as ink flowing into an ink jet printhead. The efficient fluid filtering device includes a generally flat member having a first side and a second side, and a series of fluid flow holes formed through the flat member from the first side to the second side. Importantly, the efficient fluid filtering device also has a series of pillar members, including pillar members defining a trough portion around each fluid flow hole. The pillar members and the trough portions are arranged around each hole so as to efficiently prevent bubbles and contaminants in flowing fluid from impeding fluid flow from the first side through to the second side.

19 Claims, 5 Drawing Sheets

EFFICIENT FLUID FILTERING DEVICE AND AN INK JET PRINTHEAD INCLUDING THE SAME

BACKGROUND OF THE INVENTION

In the new and emerging area of microfluidics, microfluidic carrying devices and their components are small, typically in the range of 500 microns down to as small as 1 micron and possibly even smaller. Such microfluidic devices pose difficulties with regards to preventing fluid path blockage within the microscopic componentry, and especially when the particular microscopic componentry is connected to macroscopic sources of fluid. Yet such microfluidic devices are important in a wide range of applications that include drug delivery, analytical chemistry, microchemical reactors and synthesis, genetic engineering, and marking technologies including a range of ink jet technologies, such as thermal ink jet.

The present invention relates to microfluidic devices in general and in particular to an efficient fluid filtering device for ink jet printers and, more particularly, to a thermal ink jet printhead including such an efficient fluid filtering device.

A typical thermally actuated drop-on-demand ink jet printing system uses thermal energy pulses to produce vapor bubbles in an ink-filled channel that expels droplets from the channel orifices of the printing system's printhead. Such printheads have one or more ink-filled channels communicating at one end with a relatively small ink supply chamber (or reservoir) and having an orifice at the opposite end, also referred to as the nozzle. A thermal energy generator, usually a resistor, is located within the channels near the nozzle at a predetermined distance upstream therefrom. The resistors are individually addressed with a current pulse to momentarily vaporize the ink and form a bubble which expels an ink droplet. A meniscus is formed at each nozzle under a slight negative pressure to prevent ink from weeping therefrom.

Some of these thermal ink jet printheads are formed by mating two silicon substrates. One substrate contains an array of heater elements and associated electronics (and is thus referred to as a heater plate), while the second substrate is a fluid directing portion containing a plurality of nozzle-defining channels and an ink inlet for providing ink from a source to the channels (thus, this substrate is referred to as a channel plate). The channel plate is typically fabricated by orientation dependent etching methods.

The dimensions of ink inlets to the die modules, or substrates, are much larger than the ink channels; hence, it is desirable to provide a filtering mechanism for filtering the ink at some point along the ink flow path from the ink manifold or manifold source to the ink channel to prevent blockage of the channels by particles carried in the ink. Even though some particles of a certain size do not completely block the channels, they can adversely affect directionality of a droplet expelled from these printheads. Any filtering technique should also minimize air entrapment in the ink flow path.

Various techniques are disclosed for example, in U.S. Pat. Nos. 5,154,815, and 5,204,690 for forming filters that are integral to the printhead using patterned etch resistant masks. This technique has the disadvantage of flow restriction due to the proximity to single channels and poor yields due to defects near single channels. Further, U.S. Pat. No. 4,864,329 to Kneezel et al. for example, discloses a thermal ink jet printhead having a flat filter placed over the inlet thereof by a fabrication process which laminates a wafer size filter to the aligned and bonded wafers containing a plurality of printheads.

The individual printheads are obtained by a sectioning operation, which cuts through the two or more bonded wafers and the filter. The filter may be a woven mesh screen or preferably a nickel electroformed screen with predetermined pore size. Since the filter covers one entire side of the printhead, a relatively large contact area prevents delamination and enables convenient leak-free sealing. In general, electroformed screen filters which have pore sizes small enough to filter out particles of interest, result in filters which are very thin and subject to breakage during handling or wash steps. Also, the preferred nickel embodiment is not compatible with certain inks resulting in filter corrosion. Finally, the choice of materials is limited when using this technique. Woven mesh screens are difficult to seal reliably against both the silicon ink inlet and the corresponding opening in the ink manifold. Plating with metals such as gold to protect against corrosion is costly, and in all cases, conventional filters ordinarily suffer from blockage by particles larger than the pore size, and by air bubbles.

Conventional filters used for thermal ink jet printheads help keep the jetting nozzles and channels free of clogs caused by dirt and air bubbles carried into the printhead from upstream sources such as from the ink supply cartridge. One common failing of all filters is that dirt can accumulate on the filter surface causing restricted fluid flow. Another kind of blockage is when an air bubble rests on the filter surface thereby covering a large group of fluid flow holes preventing any fluid from passing through that region of the filter.

SUMMARY OF THE INVENTION

In accordance with the present invention, there is provided an efficient fluid filtering device is provided for filtering unwanted contaminants from flowing fluid, such as ink flowing into an ink jet printhead. The efficient fluid filtering device includes a generally flat member having a first side and a second side, and a series of fluid flow holes formed through the flat member from the first side to the second side. Importantly, the efficient fluid filtering device also has a series of pillar members, including pillar members defining a trough portion around each fluid flow hole. The pillar members and the trough portions are arranged around each hole so as to efficiently prevent bubbles and contaminants in flowing fluid from impeding fluid flow from the first side through to the second side.

BRIEF DESCRIPTION OF THE DRAWINGS

In the detailed description of the invention presented below, reference is made to the drawings, in which.

DESCRIPTION OF THE INVENTION

While the present invention will be described in connection with preferred embodiments thereof, it will be understood that it is not intended to limit the invention to these embodiments. On the contrary, it is intended to cover all alternatives, modifications, and equivalents as may be included within the spirit and scope of the invention as defined by the appended claims.

Figure 1:
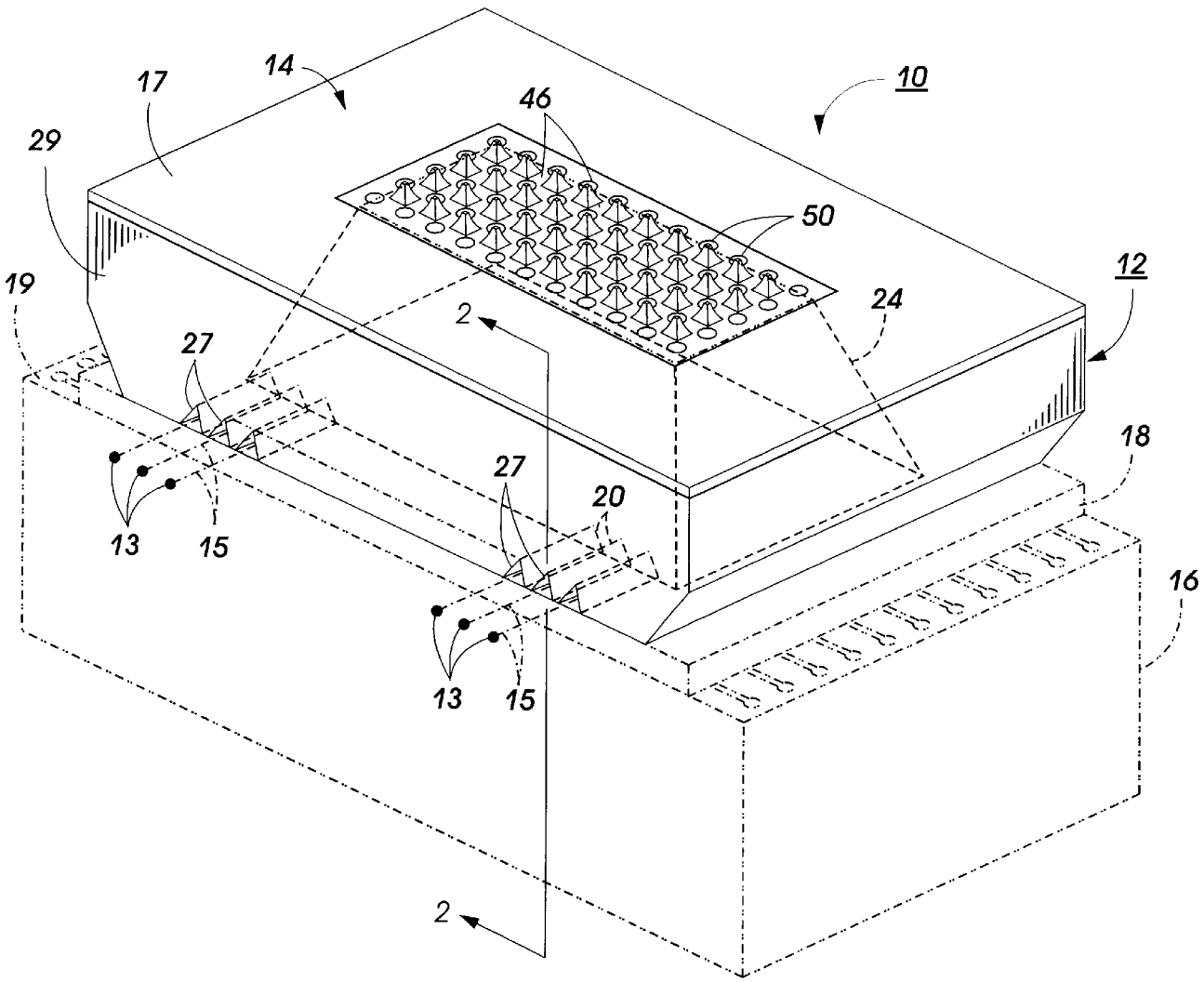
FIG. 1 is a schematic isometric view of an ink jet printhead module with an efficient filtering device of the present invention bonded to the ink inlet.
Figure 2:
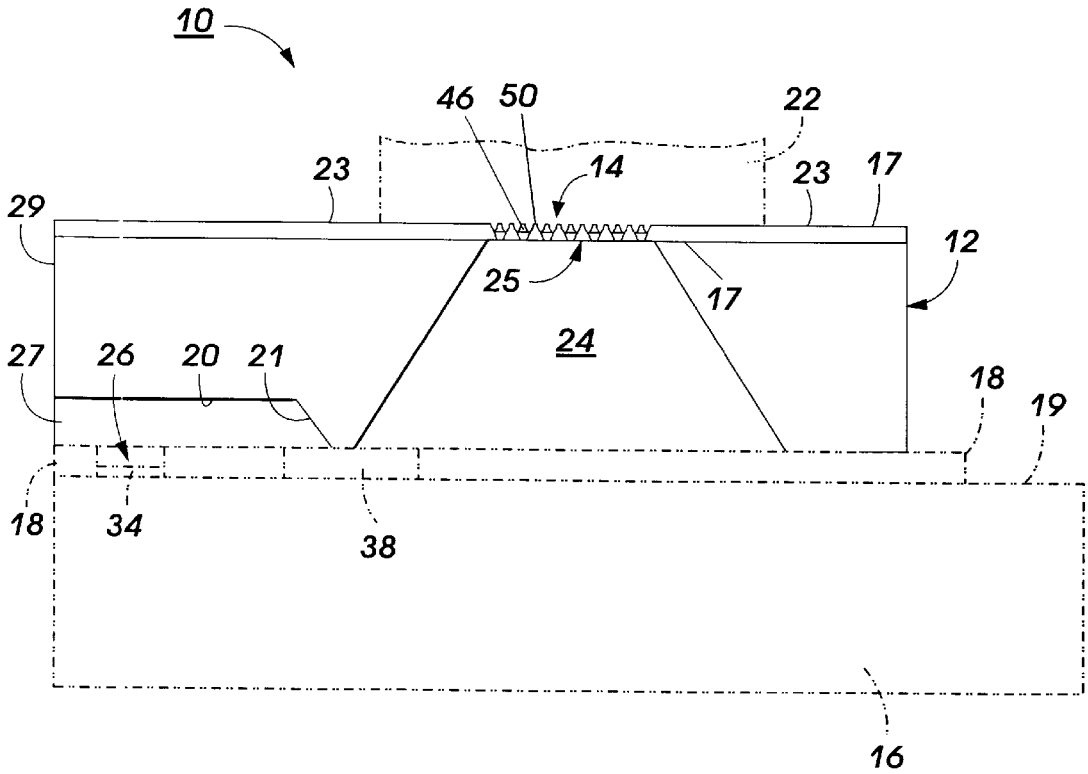
FIG. 2 is a cross-sectional view of the printhead of FIG. 1 further including an ink manifold in fluid connection with the ink inlet.

Referring first to FIGS. 1 and 2, a thermal ink jet printhead 10 fabricated according to the teachings of the present invention is shown comprising a heater plate 16 shown in dashed line, and a channel plate 12 including a laser-ablated efficient filtering device of the present invention, shown generally as 14. A patterned thick film layer 18 is shown in dashed line having a material such as, for example, Riston®, Vacrel®, or polyimide, and is sandwiched between the channel plate 12 and the heater plate 16. The thick film layer 18 is etched to remove material above each heating element 34, thus placing the heating elements in pits 26. Material is removed between the closed ends 21 of ink channels 20 and a reservoir 24, thus forming a trench 38 that places the channels 20 into fluid communication with the reservoir 24. For illustration purposes, droplets 13 are shown following trajectories 15 after ejection from the nozzles 27 in front face 29 of the printhead.

Referring in particular to FIG. 1, channel plate 12 is permanently bonded to heater plate 16 or to the patterned thick film layer 18 optionally deposited over the heating elements and addressing electrodes on the top surface 19 of the heater plate and patterned. The channel plate 12 and the heater plate 16 are both typically silicon. The illustrated embodiment of the present invention is described for an edge-shooter type printhead, but could readily be used for a roofshooter configured printhead (not shown), wherein the ink inlet is in the heater plate, so that the integral filter of the present invention could be fabricated in a similar manner.

Channel plate 12 of FIG. 1 contains an etched recess defined by walls 28, shown in dashed line, in one surface which, when mated to the heater plate 16, forms the ink reservoir 24. A plurality of identical parallel grooves 20, shown in dashed line and having triangular cross sections, are etched (using orientation dependent etching techniques) in the same surface of the channel plate with one of the ends thereof penetrating the front face 29. The other closed ends 21 (FIG. 2) of the grooves are adjacent to the recess defined by walls 28. When the channel plate and heater plate are mated and diced, the groove penetrations through front face 29 produce orifices or nozzles 27. Grooves 20 also serve as ink channels which contact the reservoir 24 (via trench 38) with the nozzles. Alternately, the ink channels may be formed in the polyimide by photopatterning or by other etching process on the channel wafer. The open bottom of the reservoir in the channel plate, shown in FIG. 2, forms an ink inlet 25 and provides means for maintaining a supply of ink in the reservoir through a manifold from an ink supply source in an ink cartridge 22, partially shown in FIG. 2. The cartridge manifold is sealed to the ink inlet by adhesive layer 23.

Referring now to FIGS. 1–6, the efficient filtering device 14 of the present invention preferably is fabricated by laser-ablating a thick film 17 of polymer material to form fluid flow side areas on a first side 42, a series of blocking pillars 50, and a series of fluid flow holes 46 therethrough. The resulting filtering device is then adhesively bonded to the first or fill hole side of channel plate 12. As shown, the efficient filtering device 14 is mounted across a fluid flow inlet, such as the ink inlet 25, for efficiently filtering such flowing fluid, by blocking and preventing air bubbles and contaminants from flowing with ink through the ink inlet into the channels and nozzles 27 of the printhead. The filtering device 14 preferably is mounted with the contoured side, or first side 42, facing the outside of the die or printhead, so as to prevent clogging or other blockage of the filter. In a preferred method of fabrication, an array of filters or filtering devices 14 is created on a single polymer film 17. The array of filters thus corresponds to die or printhead sites on the silicon channel wafer. The film is aligned and bonded to the silicon wafer. Subsequently, dicing of the wafer with attached filter or filtering device array yields individual die that have filters covering each inlet.

Still referring to FIGS. 1–6, as illustrated the efficient filtering device 14 includes the generally flat member 51 that is laser-ablated from a thick film of polymer material, and after such ablation having a first side 42 and a second side 44. The thick film of polymer material, in a preferred embodiment, is polyimide such as Kapton or Upilex, or any of other polymer films which are selected for chemical compatibility with the inks to be used. Examples of other films include polyester, polysulfone, polyetheretherketone, polyphenelyene sulfide, polyethersulfone.

Figure 3:
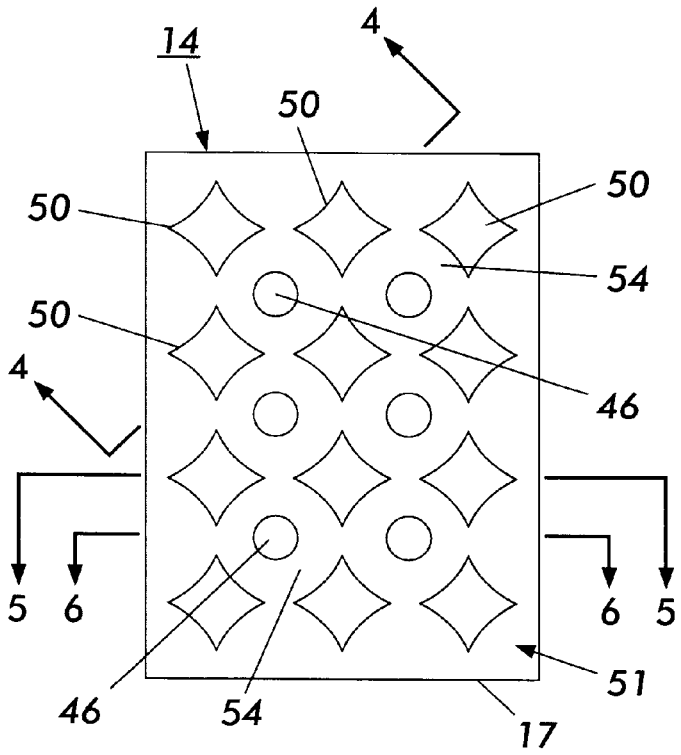
FIG. 3 is a top view illustration of a first side of an exemplary pattern of fluid flow holes and blocking pillars of the efficient filtering device of FIG. 1.
Figure 4:
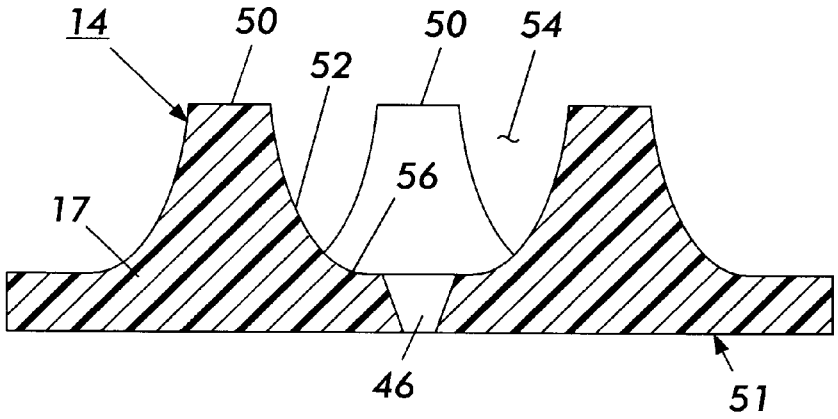
FIGS. 4–6 respectively show vertical cross-sections of a first embodiment of the filtering device of FIG. 3 taken along view-planes 4—4, 5—5 and 6—6 of FIG. 3 showing fluid flow holes and blocking pillars in accordance with the present invention.

The generally flat member 51 includes the series or pattern of fluid flow holes 46 formed through the flat member 51 from the first side 42 to the second side 44 for filtering ink flowing into the ink inlet 25 (FIG. 1), and hence into the channels and nozzles 27. The generally flat member 51 also includes a series or pattern of pillar members 50, including pillar members surrounding each fluid flow hole 46 (FIGS.3 and 4). The pillar members surrounding each fluid flow hole define a trough portion 54 around each fluid flow hole 46, and each trough portion 54 has beveled walls 52 and a base 56. As shown (FIGS. 4 and 6), each fluid flow hole 46 is formed through the base 56 of a trough portion. Each trough portion 54 as shown has a generally circular top surface, and is formed between pillar members 50, and above at least a fluid flow hole 46.

Conventional filters used for thermal ink jet printheads help keep the jetting nozzles and channels free of clogs caused by dirt and air bubbles carried into the printhead from upstream sources such as from the ink supply cartridge 22. One common failing of all filters is that dirt can accumulate on the filter or filtering device side causing restricted fluid flow. Another kind of blockage is when an air bubble rests on the filter or filtering device side thereby covering a large group of fluid flow holes preventing any fluid from passing through that region of the filter.

As pointed out above, the filtering device 14 is created from the generally flat film by laser ablation. The ablation process creates holes through the film to provide the filtering action and in the present invention also creates other side relief features (pillar members 50, troughs 54, and beveled hole-facing surfaces 52 of pillar members 50) that allow lateral ink flow along the filter or filtering device to permit ink to reach a through-hole 46 in the filter or filtering device in the presence of particles or bubbles. Accordingly, the generally flat member 51 of the efficient filtering device 14 of the present invention importantly includes a series of blocking pillar members 50 that are the remaining portions (after ablation) of the initial top side 42 of the filter or filtering device film prior to the laser ablation of the through holes 46 and side contours. The remaining pillar members 50 serve the purpose of preventing air bubbles and contaminants from reaching and potentially blocking some of the series of fluid flow holes 46. The lateral fluid flow path created by the pillars extend the useful life of the filter and thus extend the useful life of the printhead.

The use of laser ablation to create filters in polymeric materials is described for example in U.S. patent application (Ser. No. 08/926,692 to Markham, et al., relevant portions of which are incorporated herein by reference. As disclosed therein, the efficient filtering device 14 can be fabricated by laser ablation. To do so for example, output beams can be generated by an excimer laser device and directed to an appropriate mask having a plurality of holes therethrough. Laser radiation passes through the holes in the mask. The mask is imaged onto the film substrate. Laser ablation of the polymer film occurs if the illumination light from the excimer or other laser is at sufficiently high energy density, depending on the material but generally >200 mJ/cm$^2$. In the present invention, laser light not only illuminates the hole pattern on the mask but illuminates to a lesser degree the polymer between holes, thereby ablating at a slower rate material between holes to form the lateral flow channels. Thus the laser ablation process forms the series of tapered fluid flow holes 46, and the troughs 54 and hence the beveled sides 52 of pillar members 50, where the top of the pillars 50 remain as unablated areas on the first side of the film member 17 being ablated.

The filters are created on the film so as to match the ink inlets created over an entire channel wafer. The film is bonded to the wafer with the filters aligned over the ink inlets individually. The current invention differs from the above in that the current invention describes a 3-dimensionally contoured filter surface containing pillars, posts or ridges 50, 50, that hold particles of bubbles away from the filter holes 46. The pillars 50 permit fluid to flow laterally on at least one side of the filter until the fluid can flow through the filter holes 46. This lateral flow capability due to the structured filter surface reduces the tendency of a filter to be clogged.

Referring now to FIGS. 3–7, the series of fluid flow holes 46 can be formed into a pattern of spaced apart linear arrays (as shown FIG. 3) such that each fluid flow hole 46 forms part of a lateral array, as well as part of a diagonal array. As such, the series of pillar members 50 are then formed interspersed between adjacent fluid flow holes 46. The net result is each fluid flow hole 46 has a pillar member 50 (FIG. 3) on each side thereof. As shown in FIG. 4, each pillar member 50 of the series of pillar members includes a hole-facing side 52 including a beveled portion for facilitating and enhancing the trapping of air bubbles away from the adjacent fluid flow holes. Further, as shown in FIG. 3, each pillar member 50 is formed as the area outside where 3 or more trough circles 54 intersect. Each pillar or pillar member 50 has a nearly rectangular base wherein the sides of each rectangular base are formed angularly to a line through a lateral array of fluid flow holes, thereby narrowing the spacings or flow passages 53 between adjacent pillar members 50, and increasing the contaminant blocking capability of the pillar members 50.

Figure 7:
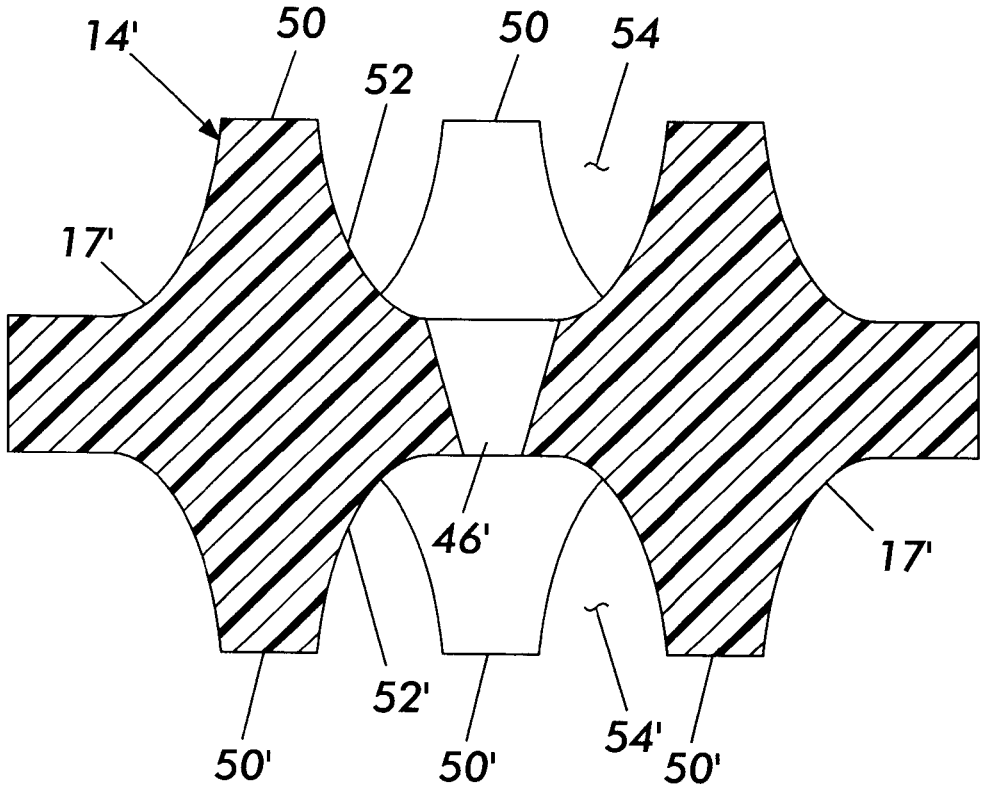
FIG. 7 is a vertical section of a second embodiment of an exemplary pattern of fluid flow holes and blocking pillars of the efficient filtering device of the present invention.

In accordance with a second embodiment of the fluid filtering device of the present invention as shown in FIG. 7, a far thicker film 17' can be ablated on both sides 42, 44 to form a thicker, generally flat member 51'. As such, pillar members 50 will be fabricated on the first side 42, and pillar members 50' on the second side 44, as shown in FIG. 7, so that the fluid flow holes 46 are located approximately midway through the thickness of the generally flat member 51'. This structure is useful in applications where relative to the direction of fluid flow, bubbles generated downstream from or on the second or downstream side 44 of the fluid flow holes 46, (as fluid levels change on such downstream side 44) can migrate backwards or upwards to the fluid flow holes, and there restrict flow through the fluid holes.

In this embodiment, the generally flat member 51' similarly includes a series or pattern of the pillar members 50', including pillar members surrounding each fluid flow hole 46. The pillar members 50' surrounding each fluid flow hole 46 define a trough portion 54' around each fluid flow hole 46, and each trough portion 54' has beveled walls 52' and a base 56'. As shown (FIG. 7), each fluid flow hole 46 is formed through the base 56' of a trough portion. The pillar members 50' advantageously act to effectively prevent air bubbles from backing up and undesirably sealing off the fluid flow holes 46 from such downstream side.

Referring still to FIGS. 1–7, the size of the efficient filtering device 14 must be large enough to provide an adequate seal across ink inlet 25 with enough edge side to allow use of adhesive layer 23 for bonding the edges. Additional filters are formed by a step and repeat process to correspond with the multiple die sites on the heater and channel wafers. In a first preferred embodiment (FIG. 3), the thickness of film member 17 before ablation, (and hence a height of each pillar member) is greater than 20 microns, and fluid flow holes 46 can be in the range of 1–100 microns diameter with preferred diameters of 5–30 microns for ink jet devices operating at 600 spots per inch. In a second preferred embodiment (FIG. 7), the thickness of film member 17' before ablation, (and hence a total height of the pillar members 50 and 50') is greater than 40 microns. The fluid flow holes 46 which are in the range of 1–100 microns diameter are preferably formed only from the first side 42 in order to maintain a desired taper. The taper angle into the holes 46 depends on process conditions and can be within about a 0.5–10° with a typical taper of 5 degrees. (The taper is exaggerated in the Figures only for descriptive purposes).

Although the examples shown in the figures correspond to die module types in which the channels and ink inlets are formed by orientation dependent etching, other fabrication methods for the fluidic pathways are compatible with the laser ablated filter or filtering device described herein. And, although the exemplary laser ablation is accomplished through a mask, alternate light transmitting systems may be used such as, for example, diffraction optics lo displays or a microlens elements. It should be understood that the efficient filtering device 14 of the present invention can be applied to thermal as well as piezoelectric or other electromechanical ink jet transducers and roof shooter geometries as well as side shooter geometries.

As described above, an ink jet fluid filter or filtering device such as the efficient filtering device 14, 14' (FIG. 7) of the present invention can be fabricated by laser ablating fluid flow holes 46 into a plastic or polymer film member 17, 17'. The ablated filter or filtering device can then be placed into the fluid flow path between an ink supply cartridge 22 and the channels 20 and nozzles 27 of an ink jet transducer or printhead so that ink can pass through the filtering device while dirt and air bubbles are trapped or blocked and prevented from reaching the fluid flow holes. As shown, the ablated film filtering device 14, 14' includes a series of pillar members 50, 50' around fluid flow or filter or filtering device holes 46. The pillar members 50, 50' function as the walls of ink flow channels and so hold most dirt particles and air bubbles away from direct contact with the fluid flow holes, while flowing liquid can find a meandering pathway around the pillar member obstructions and still reach and pass through the filter or filtering device holes. The pillar member filter or filtering device structure as such is generated by using a thicker than conventional film 17, 17', in conjunction with laser ablated holes of a controlled spacing and bevel.

The fluid flow holes 46 are easily fabricated by laser ablation. The pillar members 50, 50' can be fabricated at the same time as the holes under certain conditions described below. Each hole is tapered so that the hole at the top (side 42) of the film 17 is much larger than the hole at the bottom (side 44) of the film. If neighboring holes at the top of the film eclipse each other, then a pillar 50 is formed as shown in FIG. 3. The pillar structure can alternatively be generated by photopatterning plastic layers such as photosensitive polyamide or photosensitive polyarylene ether ketone. The pillars 50 face upstream towards the ink supply cartridge 22 (FIG. 2) so that particles and air bubbles moving downstream toward the ink inlet 25 and into the channels 20 of the ink jet printhead are caught by the pillar members 50.

Figure 5:
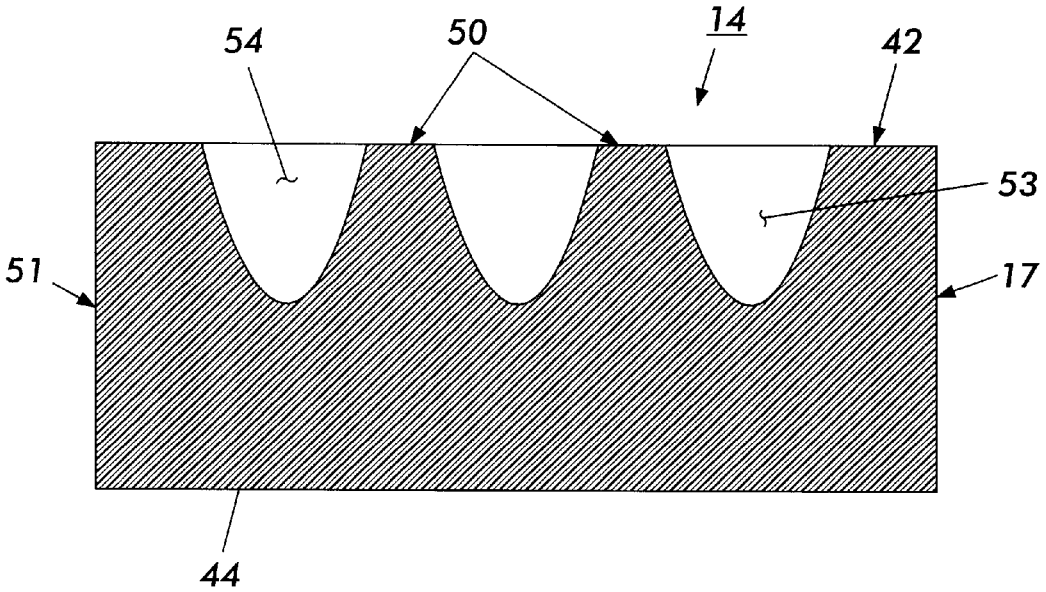
Figure 6:
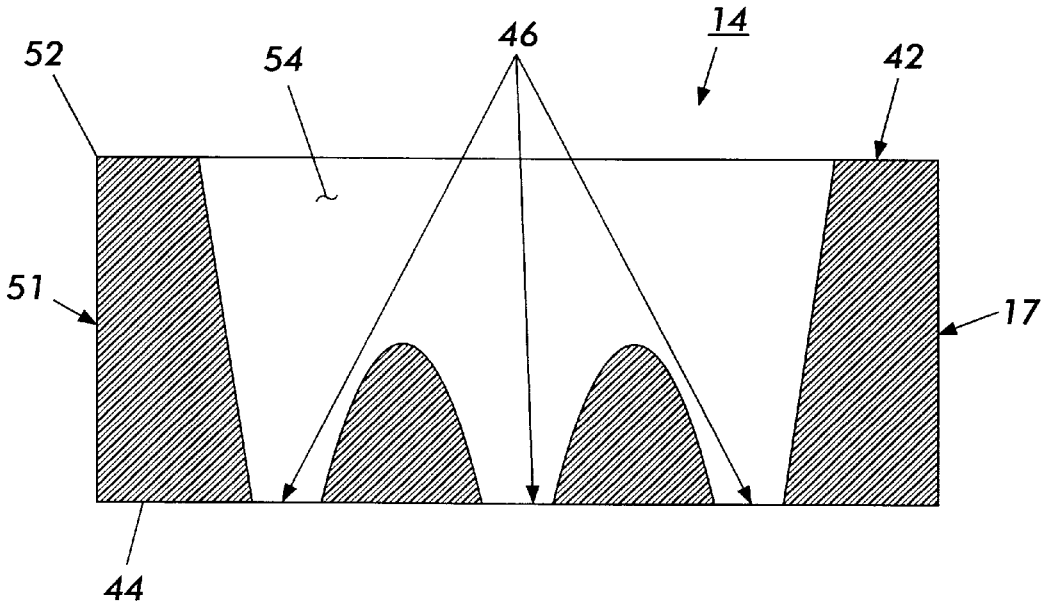

Pillar members 50, 50' preferably are formed around each hole 46, so as to protect an upstream side 42 of the hole relative to fluid flow, as well as the downstream and other side 44, so that air bubbles generated on the downstream side or other sides of the filtering, fluid flow hole, will also be held away from the fluid flow hole by a pillar. As shown in FIGS. 5 and 6, pillar height is controlled by the film thickness, the bevel angle, and the close spacing of the holes. On the upstream side 42, the spacing of the holes 46 is such that a laser ablated, large diameter portion or trough portion 54 around one hole 46 overlaps the similar, large diameter portion or trough portion 54 of the neighboring holes 46. Meanwhile, the small diameter holes themselves do not overlap with neighboring holes. The overlapping trough portions 54 around the laser ablated holes 46 result in the formation of the pillar members 50, and fluid passageways 53 that exist below the top surface and side of the film e.g., 42.

In operation, the pillars or pillar members 50 project above a fluid flow surface areas defined by passageways 53 on the side 42, so that they can trap and block dirt and air bubbles, thereby holding them away from direct contact with the fluid flow holes 46. Fluid then can flow into the fluid flow holes by first flowing around and passing along passageways 53 between the pillars 50. Air bubbles are held away from the fluid flow holes by the pillars due to the side tension of the air bubbles. In order for the air bubbles to pass through to the fluid flow holes, the air bubble must change shape to conform to the smaller space. This takes energy that would have to be provided by the flow of ink. Because the ink can flow around the air bubble, there is less energy available for distorting the air bubble. In this way, the air bubble tends to stay on the top side 42 of the pillars rather than move into the filter or filtering device cavities.

As can be seen, there has been provided an efficient fluid filtering device is provided for filtering unwanted contaminants from flowing fluid, such as ink flowing into an ink jet printhead. The efficient fluid filtering device includes a generally flat member having a first side and a second side, and a series of fluid flow holes formed through the flat member from the first side to the second side. Importantly, the efficient fluid filtering device also has a series of pillar members, including pillar members defining a trough portion around each fluid flow hole. The pillar members and the trough portions are arranged around each hole so as to efficiently prevent bubbles and contaminants in flowing fluid from impeding fluid flow from the first side through to the second side.

While the embodiments disclosed herein are preferred, it will be appreciated from this teaching that various alternative, modifications, variations or improvements therein may be made by those skilled in the art, which are intended to be encompassed by the following claims.

What is claimed is:

1. An efficient fluid filtering device comprising:

(a) a generally flat member having a first side and a second side, said generally flat member comprising a thick laser ablated film material;

(b) a series of fluid flow holes formed through said flat member from said first side to said second side; and (c) a series of pillar members including pillar members defining a trough portion around each fluid flow hole of said series of fluid flow holes, said pillar members and said trough portions being arranged so as to efficiently prevent bubbles and contaminants from impeding fluid flow from said first side through said second side.

2. The efficient fluid filtering device of claim 1, wherein said thick laser ablated film material comprises a polymer film.

3. The efficient fluid filtering device of claim 1, wherein said series of fluid flow holes comprise spaced apart linear arrays of said fluid flow holes.

4. The efficient fluid filtering device of claim 1, wherein said series of pillar members is comprised of pillar members formed interspersed between adjacent holes of said series of holes.

5. The efficient fluid filtering device of claim 3, wherein said linear arrays of said series of fluid flow holes comprise lateral arrays and diagonal arrays.

6. The efficient fluid filtering device of claim 5, wherein each pillar member of said series of pillar members includes a hole-facing surface having a beveled portion for facilitating and enhancing trapping of air bubbles away from adjacent fluid flow holes.

7. The efficient fluid filtering device of claim 6, wherein said series of pillar members is formed on said first side and on said second side of said generally flat member.

8. The efficient fluid filtering device of claim 6, wherein each pillar member of said series of pillar members has a plurality of said hole-facing surfaces.

9. The efficient fluid filtering device of claim 6, wherein hole-facing surfaces of said series of pillar members are formed angularly relative to a line through a lateral array of fluid flow holes of said series of fluid flow holes.

10. The efficient fluid filtering device of claim 6, wherein each fluid hole of said series of fluid holes is tapered.

11. The efficient fluid filtering device of claim 6, wherein each trough portion lies between pillars and above a fluid flow hole.

12. The efficient fluid filtering device of claim 6, wherein each trough portion has a generally circular top opening.

13. The efficient fluid filtering device of claim 6, wherein said series of pillar members is formed only on said first side of said generally flat member.

14. An ink jet printhead assembly comprising:

(a) ink supplying manifold;

(b) a printhead having ink ejecting nozzles and an ink inlet for receiving ink flowing from said ink supplying manifold; and (c) an efficient filtering device mounted across said ink inlet for blocking and preventing air bubbles and contaminants flowing with ink into said ink inlet towards said printhead, and for efficiently filtering such ink, said efficient filtering device including:

(i) a generally flat member having a first side and a second side, said generally flat member comprising a thick laser ablated film material;

(ii) a series of fluid flow holes formed through said flat member from said first side to said second side for filtering ink flowing into said ink inlet; and (iii) a series of pillar members including pillar members defining a trough portion around each fluid flow hole of said series of fluid flow holes, said pillar members and said trough portions being arranged so as to efficiently prevent bubbles and contaminants in flowing ink from impeding ink flow from said first side through said second side.

15. The ink jet printhead of claim 14, wherein said series of pillar members is formed on said first side and on said second side of said generally flat member.

16. The ink jet printhead of claim 14, wherein each fluid hole of said series of fluid holes is tapered.

17. The ink jet printhead of claim 14, wherein each trough portion lies between pillars and above a fluid flow hole.

18. The ink jet printhead of claim 14, wherein each trough portion has a generally circular top opening.

19. The ink jet printhead of claim 14, wherein said series of pillar members is formed only on said first side of said generally flat member.

* * * * *